US010191448B2

(12) United States Patent
Ogiwara et al.

(10) Patent No.: US 10,191,448 B2
(45) Date of Patent: Jan. 29, 2019

(54) IMAGE FORMING APPARATUS WITH VENTILATION GUIDES FOR EXHAUSTING AIR AND METHOD ASSOCIATED WITH THE SAME

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takashi Ogiwara, Shizuoka (JP); Kazumasa Yasui, Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/467,128

(22) Filed: Mar. 23, 2017

(65) Prior Publication Data

US 2018/0275602 A1 Sep. 27, 2018

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92
See application file for complete search history.

(56) References Cited

U.S. PATENT DOCUMENTS

| | | | | |
|---|---|---|---|---|
| 6,356,722 | B1 * | 3/2002 | Kida | H04N 1/00519 399/92 |
| 8,014,695 | B2 | 9/2011 | Watanabe et al. | |
| 8,712,278 | B2 | 4/2014 | Yamaguchi et al. | |
| 2009/0010672 | A1 * | 1/2009 | Watanabe | G03G 21/206 399/92 |

* cited by examiner

*Primary Examiner* — Quana M Grainger
(74) *Attorney, Agent, or Firm* — Amin, Turocy & Watson LLP

(57) ABSTRACT

According to one embodiment, there is provided an image forming apparatus including a fixing portion, an exterior member, a first ventilation guide, a second ventilation guide, and a blowing portion. The exterior member has a first opening portion opened to an outside. The first ventilation guide is disposed between the fixing portion and the exterior member. The first ventilation guide forms a first space communicating with the first opening portion between the first ventilation guide and the exterior member. The second ventilation guide is disposed between the fixing portion and the first ventilation guide, and has a second opening portion. The second ventilation guide forms a second space communicating with the second opening portion between the second ventilation guide and the first ventilation guide.

19 Claims, 12 Drawing Sheets

IMAGE FORMING APPARATUS WITH VENTILATION GUIDES FOR EXHAUSTING AIR AND METHOD ASSOCIATED WITH THE SAME

FIELD

Embodiments described herein relate generally to an image forming apparatus and methods associated therewith.

BACKGROUND

An exterior member of an image forming apparatus may become warm due to heat emitted from a fixing portion or the like of the image forming apparatus. Generally, the hot exterior member is disposed at a position away from an operator to avoid injury.

However, from the viewpoint of downsize of the image forming apparatus, there is an increased chance that the image forming apparatus has a configuration in which the hot exterior member is positioned near the operator.

DETAILED DESCRIPTION

Figure 1:
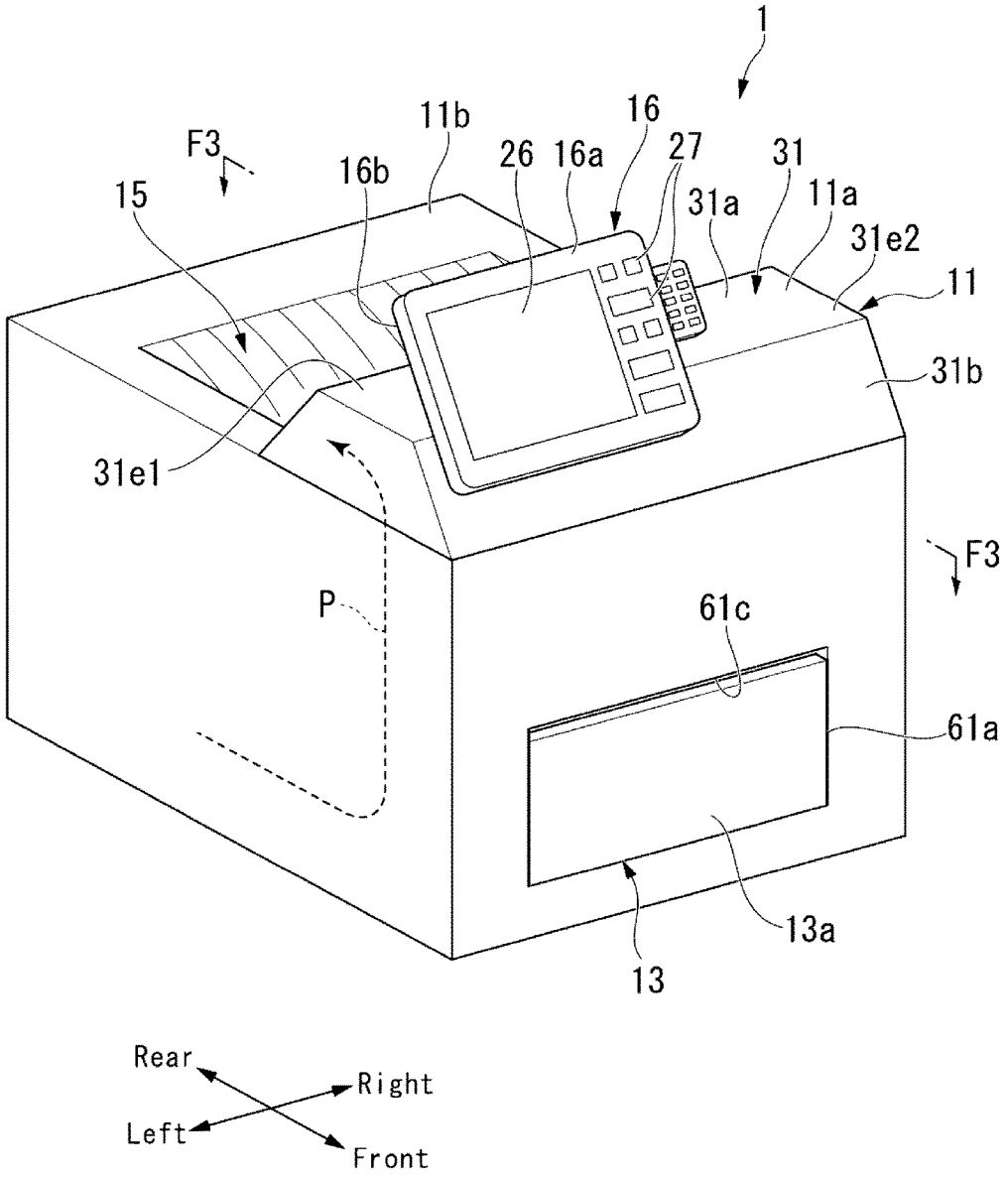
FIG. 1 is a perspective view schematically illustrating an appearance of an image forming apparatus of a first embodiment.

An image forming apparatus of an embodiment has a fixing portion, an exterior member, a first ventilation guide, a second ventilation guide, and a blowing portion. The exterior member has a first opening portion opened to an outside. The first ventilation guide is disposed between the fixing portion and the exterior member. The first ventilation guide forms a first space communicating with the first opening portion between the first ventilation guide and the exterior member. The second ventilation guide is disposed between the fixing portion and the first ventilation guide. The second ventilation guide has a second opening portion positioned closer to the fixing portion than the first space. The second ventilation guide forms a second space communicating with the second opening portion between the second ventilation guide and the first ventilation guide. The blowing portion exhausts air inside the first space and the second space.

Hereinafter, the image forming apparatus of the embodiment will be described with reference to the drawings. Here, first, "front", "rear", "left", and "right" in the embodiment are defined. "Front" means a side closer to an operator standing at a position where characters of a control panel 16 of an image forming apparatus 1 appear in a correct orientation than a center portion of an inside of the image forming apparatus 1. On the other hand, "rear" means a side farther to an operator standing at the position where characters of the control panel 16 appear in the correct orientation than the center portion of the inside of the image forming apparatus 1. "Left" and "right" respectively means "left" and "right" with respect to the operator standing at the position where characters of the control panel 16 appear in the correct orientation. In the drawings described below, a front side is referred to as "front", a rear side is referred to as "rear", a left side is referred to as "left, and a right side is referred to as "right".

First Embodiment

First, a first embodiment will be described with reference to FIGS. 1 to 6.

Figure 2:
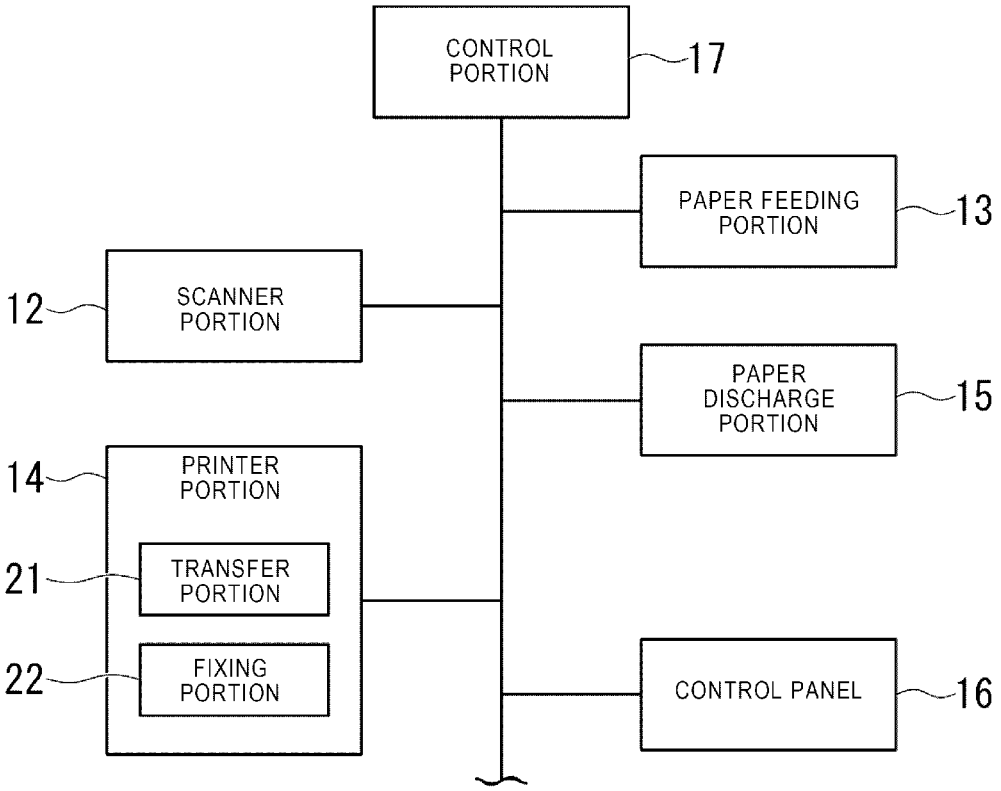
FIG. 2 is a block diagram illustrating a system configuration example of the image forming apparatus of the first embodiment.

FIG. 1 is a perspective view schematically illustrating an appearance of an image forming apparatus 1 of the first embodiment. In FIG. 1, a scanner portion 12 is not illustrated. FIG. 2 is a block diagram illustrating a system configuration example of the image forming apparatus 1. For example, the image forming apparatus 1 is a Multi Function Peripheral (MFP). However, the image forming apparatus 1 is not limited to the above example and may be a copy machine, a printer, or the like.

The image forming apparatus 1 of the embodiment is, for example, a front rolling type image forming apparatus. After an image is formed while a sheet S passes through a position close to an operator on an inside of the image forming apparatus 1, the sheet S is discharged in a direction away from the operator (see an arrow P in FIG. 1). Therefore, a component such as a fixing portion 22 which is relatively high in temperature and a transporting path through which the heated sheet S passes are disposed on a side close to the operator on the inside of the image forming apparatus 1. However, the image forming apparatus 1 is not limited to the front rolling type image forming apparatus.

First, an entire configuration of the image forming apparatus 1 will be described.

As illustrated in FIGS. 1 and 2, for example, the image forming apparatus 1 includes a housing 11, the scanner portion 12, a paper feeding portion 13, a printer portion 14, a paper discharge portion 15, a control panel 16, and a control portion 17.

The housing 11 forms an outer shell of the image forming apparatus 1. For example, the housing 11 accommodates the paper feeding portion 13, the printer portion 14, the paper discharge portion 15, and the control portion 17. In addition, the housing 11 has a front portion 11*a* and a rear portion 11*b*. The front portion 11*a* is a region that is positioned at a position closer to an operator standing at a position where characters of the control panel 16 appear in the correct orientation than a center portion of the inside of the image forming apparatus 1. On the other hand, the rear portion 11*b* is a region that is positioned at a position farther to the operator standing at the position where characters of the control panel 16 appear in the correct orientation than the center portion of the inside of the image forming apparatus 1.

The paper feeding portion 13 includes a paper feeding cassette, a manual feeding tray 13*a*, and a pickup roller. The manual feeding tray 13*a* can be opened and closed with respect to the housing 11. The sheet S is loaded while the manual feeding tray 13*a* is in an opened state with respect to the housing 11. The pickup roller sends the sheet S loaded on the manual feeding tray 13*a* to the printer portion 14.

The printer portion 14 forms an image on the sheet S based on image data. The printer portion 14 includes a transfer portion 21 and the fixing portion (fixing device) 22. The transfer portion 21 includes an electrostatic charger, a photoconductive drum, an exposure unit, a developing device, and a transfer roller. The transfer portion 21 transfers a toner image formed on a surface of the photoconductive drum to the sheet S. The fixing portion 22 includes a heat roller 22*a* and a press roller 22*b* (see FIG. 3). The fixing portion 22 heats and presses the sheet S passing between the heat roller 22*a* and the press roller 22*b*. The sheet S to which the toner image is transferred is heated and pressed, and thereby the fixing portion 22 fixes the toner image on the sheet S. In the embodiment, the fixing portion 22 is disposed at the front portion 11*a* of the housing 11.

Figure 3:
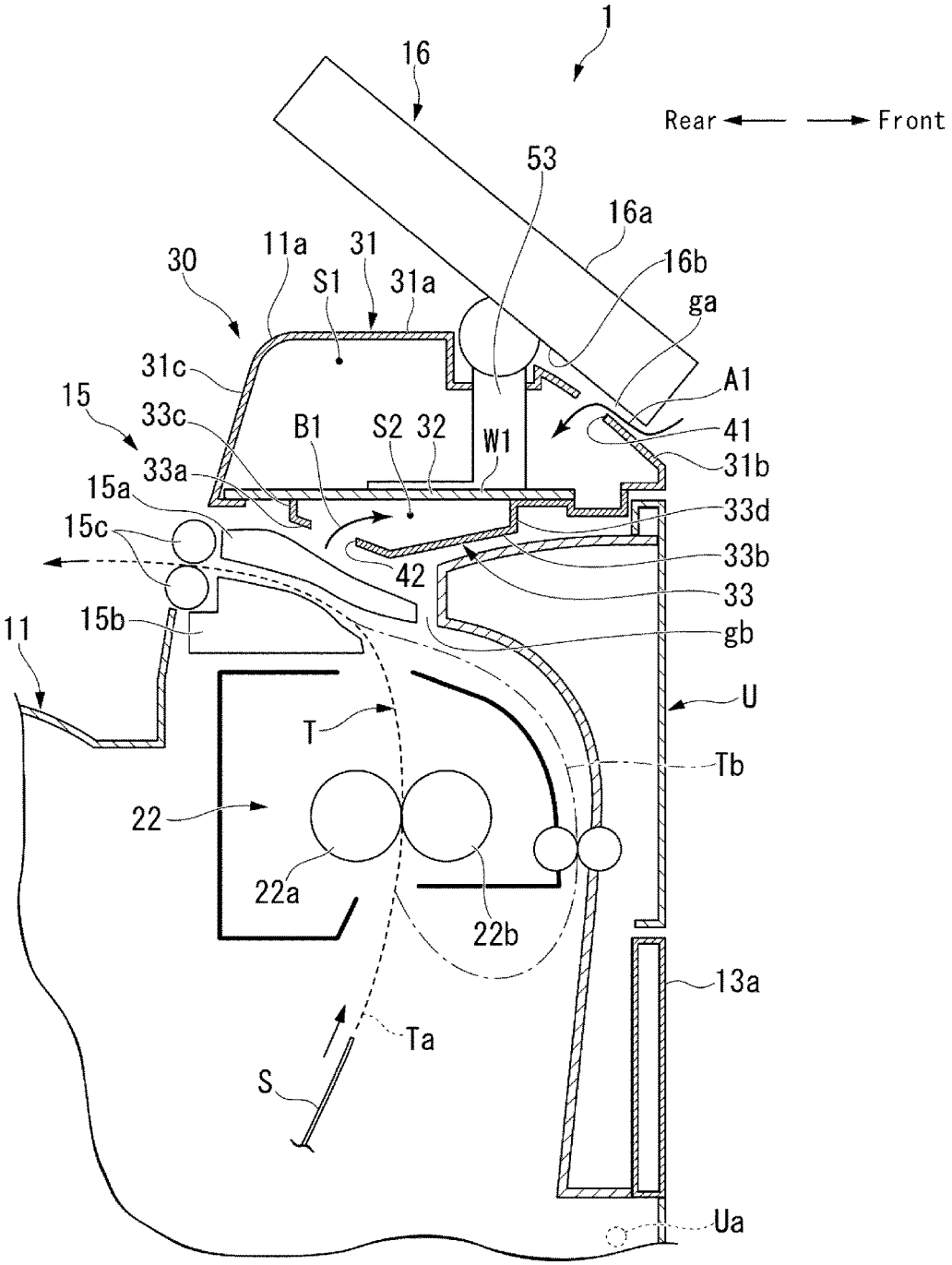
FIG. 3 is a sectional view that is taken along line F3-F3 of the image forming apparatus illustrated in FIG. 1.

The paper discharge portion 15 includes a first paper discharge guide 15*a*, a second paper discharge guide 15*b*, and paper discharge rollers 15*c* (see FIG. 3). A part of a transporting path T, in which the sheet S is transported, is formed between the first paper discharge guide 15*a* and the second paper discharge guide 15*b*. The transporting path T includes a transporting path Ta which is formed from the paper feeding portion 13 to the paper discharge portion 15 through the printer portion 14, and a transporting path Tb (reverse path) through which the sheet S passes during double-sided printing. The paper discharge rollers 15*c* discharge the sheet S passing between the first paper discharge guide 15*a* and the second paper discharge guide 15*b* to the outside of the housing 11. In addition, the paper discharge rollers 15*c* is rotated reversely during double-sided printing, thereby sending the sheet S to the transporting path Tb (reverse path).

Returning to FIG. 1, the control panel 16 has a display portion 26 and an input receiving portion 27. The display portion 26 includes a display screen. Various types of information are displayed on the display portion 26. The input receiving portion 27 includes a plurality of buttons. The input receiving portion 27 receives inputs of various operation instructions. However, the input receiving portion 27 may be realized by a touch panel (touch sensor) provided on the display screen.

The control portion 17 controls the entire image forming apparatus 1. For example, the control portion 17 controls operations of the scanner portion 12, the paper feeding portion 13, the printer portion 14, the paper discharge portion 15, and the control panel 16.

Next, a cooling structure 30 provided in the image forming apparatus 1 of the embodiment will be described. FIG. 3 is a sectional view that is taken along line F3-F3 of the image forming apparatus 1 illustrated in FIG. 1. As illustrated in FIG. 3, the cooling structure 30 includes a top cover 31, a stay member 32, a heat exhaust path forming member 33, and a blowing portion 34 (see FIG. 5).

First, the top cover 31 will be described.

The top cover 31 is an example of a "first exterior member". The top cover 31 forms a part of the outer shell of the image forming apparatus 1 as a part of the housing 11. For example, the top cover 31 forms a part of an upper surface (upper surface of the housing 11) of the image forming apparatus 1. The top cover 31 is disposed in the front portion 11*a* of the housing 11. The top cover 31 is disposed above the fixing portion 22. For example, the top cover 31 is provided across an entire width of the housing 11 so as to extend between a left end portion and a right end portion of the housing 11 (see FIG. 1).

In the embodiment, the top cover 31 has an upper wall 31*a*, a front wall 31*b*, and a rear wall 31*c*. The upper wall 31*a* extends substantially horizontally. The front wall 31*b* extends obliquely downward of a front side from a front end portion of the upper wall 31*a*. On the other hand, the rear wall 31*c* extends obliquely downward of a rear side from a rear end portion of the upper wall 31*a*. Therefore, the top cover 31 is formed in a recessed shape of which a lower side is opened.

The top cover 31 has at least one (for example, plural) first opening portion 41 that is opened to the outside (outside of the housing 11) of the image forming apparatus 1. For example, the first opening portion 41 is provided on the front wall 31*b* of the top cover 31.

Here, in the embodiment, the control panel 16 is disposed above the top cover 31. For example, the control panel 16 has a first surface 16*a* and a second surface 16*b*. The first surface 16*a* includes the display portion 26 and the input receiving portion 27. The second surface 16*b* is positioned on a side opposite to the first surface 16*a*. The front wall 31*b* of the top cover 31 faces the second surface 16*b* of the control panel 16. A gap ga is provided between the front wall 31*b* of the top cover 31 and the second surface 16*b* of the control panel 16.

Viewed from another viewpoint, as illustrated in FIG. 1, the top cover 31 has a first end portion 31*e*1 and a second end portion 31*e*2. For example, the first end portion 31*e*1 is a left end portion of the top cover 31. The second end portion 31*e*2 is a right end portion of the top cover 31. Therefore, the control panel 16 is disposed closer to the first end portion 31*e*1 of the top cover 31 than a center portion of the top cover 31 in a width direction of the housing 11. The "width direction of the housing" is a direction from the first end portion 31*e*1 to the second end portion 31*e*2 of the top cover 31. If the control panel 16 is disposed closer to one of the right and left ends of the top cover 31, it is easy for the operator to reach out to the paper discharge portion 15 behind the control panel 16 as viewed from the operator. For example, if the control panel 16 is disposed closer to the left end portion of the top cover 31, the operator can easily extend the right hand, which is a dominant hand of many operators, to the paper discharge portion 15.

Figure 4:
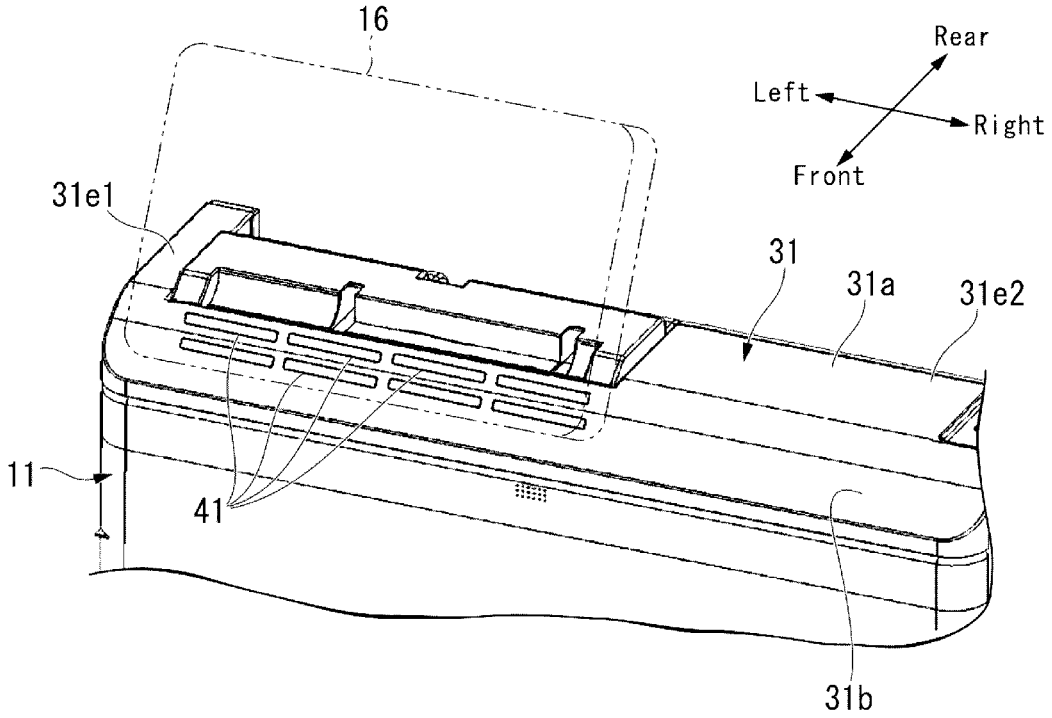
FIG. 4 is a perspective view illustrating a top cover of the first embodiment.

FIG. 4 is a perspective view illustrating the top cover 31 in a state where the control panel 16 is removed. As illustrated in FIG. 4, for example, a plurality of first opening portions 41 are provided in a region of the top cover 31 which is covered by the control panel 16 when the control panel 16 is viewed in a front view. "When the control panel is viewed in a plan view" means, for example, a case where the control panel 16 is viewed from a direction substantially perpendicular to the display portion 26. In addition, in the embodiment, equal to or greater than half of the plurality of first opening portions 41 is positioned closer to the first end portion 31*e*1 of the top cover 31 than the center portion of the top cover 31 in the width direction (longitudinal direction of the top cover 31) of the housing 11.

Next, the stay member 32 will be described.

The stay member 32 is an example of a "first ventilation guide". The "ventilation guide" referred to in the present application is not limited to a member that forms a duct. The "ventilation guide" broadly means a member that guides a flow of air. For example, the "ventilation guide" is not necessarily provided over an entire length and an entire width of a space to be a ventilation path, and may also be a member that is partially provided for the entire length and the entire width of the space to be the ventilation path. In other words, the "ventilation guide" may be a member that defines at least a part of the ventilation path.

Figure 5:
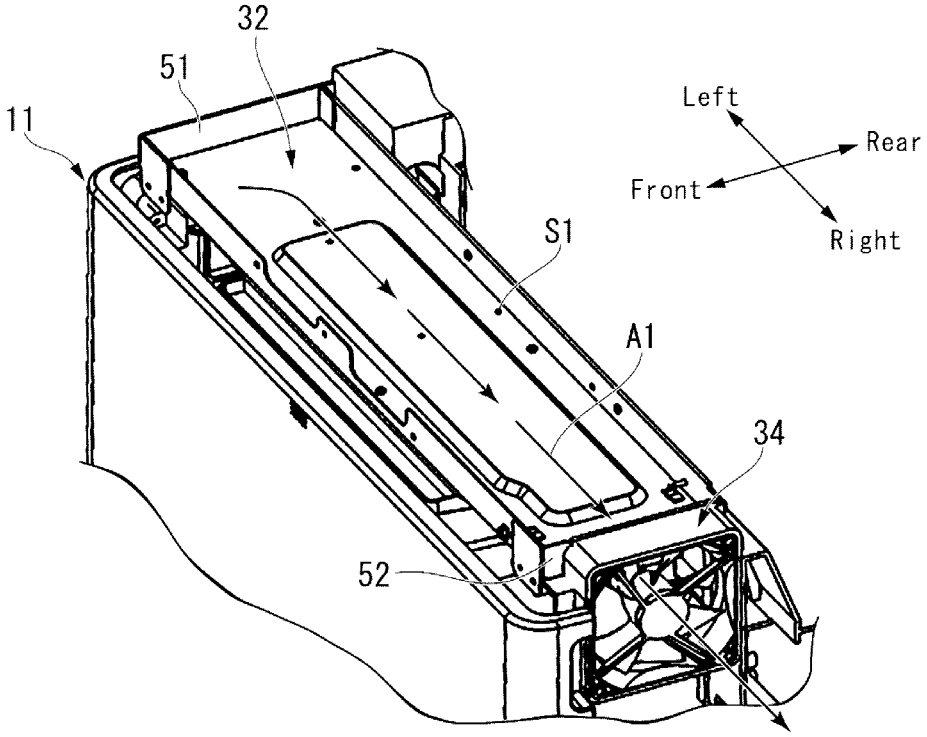
FIG. 5 is a perspective view illustrating a stay member of the first embodiment.

FIG. 5 is a perspective view illustrating the stay member 32 in a state where the top cover 31 is removed. As illustrated in FIG. 5, the stay member 32 is one of reinforcing members for reinforcing the image forming apparatus 1. For example, the image forming apparatus 1 has a first structure member 51 that is provided at the left end portion of the housing 11 and a second structure member 52 that is provided at the right end portion of the housing 11. The stay member 32 extends between the first structure member 51 and the second structure member 52 so as to connect the first structure member 51 and the second structure member 52. For example, the stay member 32 is a plate-like sheet metal member extending along a substantially horizontal direction. In addition, viewed from another viewpoint, the stay member 32 is also a base member to which the control panel 16 is attached. A support member 53 (for example, a fixed bracket) that supports the control panel 16 is attached to the stay member 32 (see FIG. 3).

As illustrated in FIG. 3, the stay member 32 is disposed between the fixing portion 22 and the top cover 31. The stay member 32 faces an internal space of the top cover 31 from a lower side. Therefore, a first space S1, which is at least a part of a first ventilation path through which cooling air flows, is formed between the stay member 32 and the top cover 31. For example, the first space S1 is a space surrounded by the upper wall 31*a*, the front wall 31*b*, and the rear wall 31*c* of the top cover 31, and the stay member 32. The first space S1 communicates with the first opening portion 41 of the top cover 31. The first space S1 is formed along an inner surface of the top cover 31. The first space S1 is formed along the longitudinal direction of the top cover 31.

Next, the heat exhaust path forming member 33 will be described.

The heat exhaust path forming member 33 is an example of a "second ventilation guide".

Figure 6:
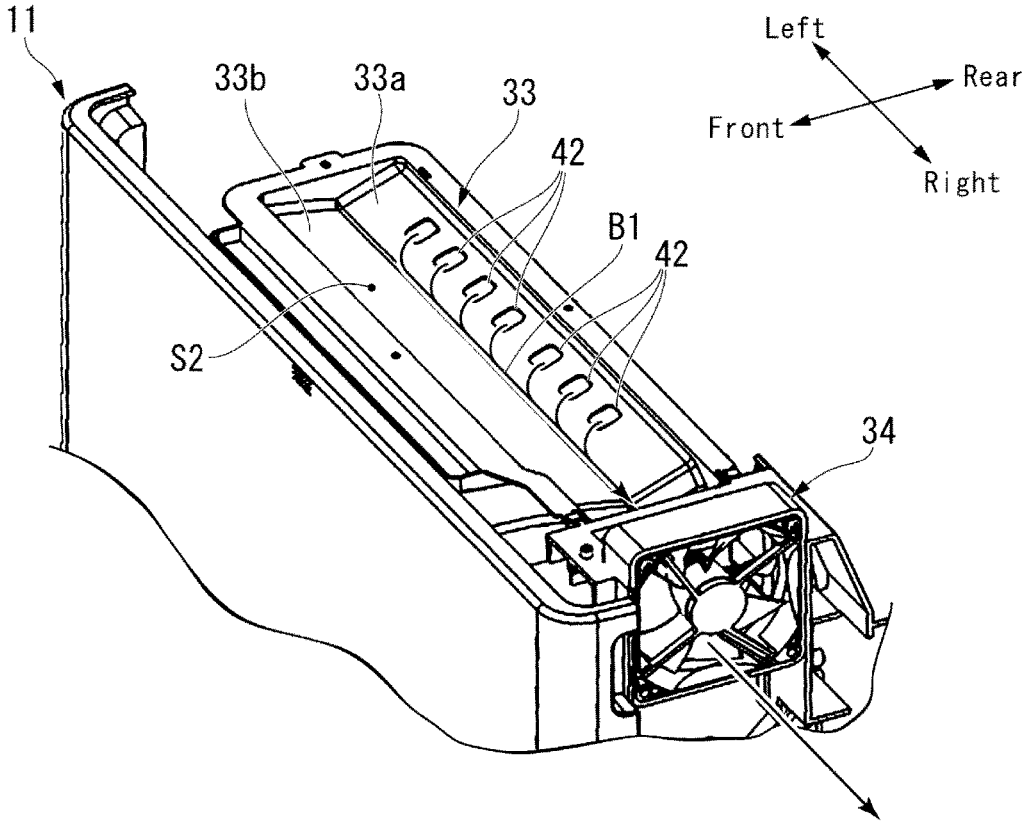
FIG. 6 is a perspective view illustrating a heat exhaust path forming member of the first embodiment.

FIG. 6 is a perspective view illustrating the heat exhaust path forming member 33 in a state where the top cover 31 and the stay member 32 are removed. As illustrated in FIG. 6, the heat exhaust path forming member 33 is a member that forms a heat exhaust path exhausting air that is heated by the sheet S passing through the fixing portion 22 and the transporting path T to the outside of the image forming apparatus 1. The heat exhaust path forming member 33 extends in the width direction of the housing 11.

The heat exhaust path forming member 33 has at least one (for example, plural) second opening portion 42 that is opened to the inside of the housing 11. In the embodiment, a plurality of second opening portions 42 are arranged in the width direction of the housing 11. The plurality of second opening portions 42 are disposed at substantially equally to the left and right with respect to the center portion of the housing 11 in the width direction of the housing 11.

As illustrated in FIG. 3, the heat exhaust path forming member 33 is disposed between the stay member 32 and the fixing portion 22. The heat exhaust path forming member 33 has a first bottom wall portion 33*a*, a second bottom wall portion 33*b*, a first upright wall 33*c*, and a second upright wall 33*d*. The first bottom wall portion 33*a* is inclined with respect to a horizontal surface so as to follow an inclination of the transporting path T of the sheet S (for example, so as to follow the first paper discharge guide 15*a*). For example, the first bottom wall portion 33*a* is inclined so as to be positioned downward as the first bottom wall portion 33*a* advances to the front side of the housing 11. The second bottom wall portion 33*b* is positioned on the front side of the housing 11 than the first bottom wall portion 33*a*. The second bottom wall portion 33*b* is inclined with respect to the horizontal surface so as to follow a part of an outer shape of Automatic Duplex Copy Unit (ADU unit) U which is described in a second embodiment in detail. The second bottom wall portion 33*b* is inclined so as to be positioned upward as the second bottom wall portion 33*b* advances to the front side of the housing 11. The first bottom wall portion 33*a* and the second bottom wall portion 33*b* are respectively inclined so that an internal space of the heat exhaust path forming member 33 is formed to be relatively wide. The first upright wall 33*c* extends above from a rear end portion of the first bottom wall portion 33*a*. The second upright wall 33*d* extends above from a front end portion of the second bottom wall portion 33*b*. Therefore, the heat exhaust path forming member 33 is formed in a recessed shape of which an upper side is opened.

The plurality of second opening portions 42 are provided in the first bottom wall portion 33*a* of the heat exhaust path forming member 33. The plurality of second opening portions 42 are positioned closer to the fixing portion 22 than the first space S1. The second opening portion 42 is positioned above from the fixing portion 22 and the transporting path T. For example, the second opening portion 42 is positioned above at least a part of the fixing portion 22. The second opening portion 42 is opened downward. The second opening portion 42 communicates with the transporting path T through a gap gb between the first paper discharge guide 15*a* and the ADU unit U, and the like. In addition, the second opening portion 42 communicates with at least a part of a space in a periphery of the fixing portion 22 through the transporting path T.

As illustrated in FIG. 3, the heat exhaust path forming member 33 is disposed between the fixing portion 22 and the stay member 32. The stay member 32 faces the internal space of the heat exhaust path forming member 33 from above. Therefore, a second space S2, which is at least a part of the second ventilation path through which exhaust hot air flows, is formed between the heat exhaust path forming member 33 and the stay member 32. For example, the second space S2 is a space surrounded by the stay member 32, the first bottom wall portion 33*a*, the second bottom wall portion 33*b*, the first upright wall 33*c*, and the second upright wall 33*d* of the heat exhaust path forming member 33. The second space S2 communicates with the second opening portion 42 of the heat exhaust path forming member 33. The second space S2 is formed along the inner surface of the heat exhaust path forming member 33. For example, the second space S2 is formed along a longitudinal direction of the top cover 31.

At least one of the stay member 32 and the heat exhaust path forming member 33 has a partition wall W1 that partitions between the first space S1 and the second space S2. The partition wall W1 forms a boundary portion between the first space S1 and the second space S2. In the embodiment, the partition wall W1 is formed by the stay member 32. The partition wall W1 is positioned on a side opposite to the transporting path T of the sheet S with respect to the first bottom wall portion 33*a* of the heat exhaust path forming member 33. In other words, the partition wall W1 is positioned farther away from the first bottom wall portion 33*a* of the heat exhaust path forming member 33 with respect to the transporting path T of the sheet S. The partition wall W1 is an example of a "first wall". The first bottom wall portion 33*a* of the heat exhaust path forming member 33 is an example of a "second wall".

Next, the blowing portion 34 will be described.

The blowing portion 34 is formed of at least one fan. For example, the blowing portion 34 is adjacent to the second end portion 31*e*2 of the top cover 31. The blowing portion 34 faces the first space S1 and the second space S2 in the width direction of the housing 11. The blowing portion 34 exhausts air on the inside of the first space S1 and the second space S2 to the outside of the image forming apparatus 1. For example, the blowing portion 34 exhausts air on the inside of the first space S1 and the second space S2 to the right side of the image forming apparatus 1. However, the blowing portion 34 may be formed by a plurality of fans.

Next, an operation of the image forming apparatus 1 of the embodiment will be described.

In the embodiment, when the blowing portion 34 is driven, as illustrated by an arrow A1 in FIG. 3, cold air on the outside of the housing 11 flows into the first space S1 from the first opening portion 41 through the gap ga between the front wall 31*b* of the top cover 31 and the second surface 16*b* of the control panel 16 as cooling air. Therefore, as illustrated by an arrow A1 in FIG. 5, air flowing into the first space S1 from the first opening portion 41 flows through the first space S1 along the longitudinal direction of the top cover 31. Some of air flowing into the first space S1 from the first opening portion 41 flows along the inner surface of the top cover 31. Therefore, cooling of the top cover 31 is promoted. In addition, some of air flowing into the first space S1 from the first opening portion 41 flows along the partition wall W1 that partitions between the first space S1 and the second space S2. Therefore, cooling of the partition wall W1 is promoted. Air flowing through the first space S1 is exhausted by the blowing portion 34 from the first space S1 to the outside of the image forming apparatus 1.

In addition, when the blowing portion 34 is driven, as illustrated by an arrow B1 in FIG. 3, air positioned in a periphery of the fixing portion 22 and the transporting path T flows into the second space S2 from the second opening portion 42 as exhaust hot air. Therefore, as illustrated by an arrow B1 in FIG. 6, air flowing into the second space S2 from the second opening portion 42 flows through the second space S2 along the longitudinal direction of the top cover 31. Air flowing through the second space S2 is exhausted by the blowing portion 34 from the second space S2 to the outside of the image forming apparatus 1.

According to the configuration described above, a cooling performance of the image forming apparatus 1 can be enhanced.

Here, for example, according to the front rolling type image forming apparatus 1, it is easy to downsize the image forming apparatus 1. Furthermore, according to the front rolling type image forming apparatus 1, it is easy to access necessary components when paper jam occurs. On the other hand, according to the front rolling type image forming apparatus 1, the fixing portion 22 and the transporting path T through which the heated sheet S passes are disposed in positions adjacent to the operator. Therefore, the top cover 31 and the control panel 16 relatively adjacent to the operator become warm. However, in order to cool the top cover 31 and the control panel 16, if cooling air is simply introduced into the housing 11, a temperature of the fixing portion 22 may decrease. If the temperature of the fixing portion 22 decreases, power consumption of the fixing portion 22 increases.

Therefore, in the embodiment, the image forming apparatus 1 includes the stay member 32, the heat exhaust path forming member 33, and the blowing portion 34. The stay member 32 is disposed between the fixing portion 22 and the top cover 31. The stay member 32 forms the first space S1 communicating with the outside between the stay member 32 and the top cover 31. The heat exhaust path forming member 33 is disposed between the fixing portion 22 and the stay member 32. The heat exhaust path forming member 33 has the second opening portion 42 that is positioned closer to the fixing portion 22 than the first space S1. The heat exhaust path forming member 33 forms the second space S2 communicating with the second opening portion 42 between the heat exhaust path forming member 33 and the stay member 32. The blowing portion 34 exhausts air on the inside of the first space S1 and the second space S2.

According to the configuration described above, the ventilation path of a two-layer structure is formed in the inside of the housing 11. Therefore, cold air of the outside of the housing 11 flows into the first space S1, which is a first layer, as cooling air and thereby it is possible to efficiently cool the top cover 31. In addition, cooling air flows through the first space S1 and thereby the boundary portion (partition wall W1) between the first space S1 and the second space S2 can be cooled. Therefore, heat is unlikely to be transferred from warm air within the housing 11 to the top cover 31 and the control panel 16. Therefore, it is possible to suppress an increase in the temperature of the top cover 31 and the control panel 16.

In addition, warm air in the periphery of the fixing portion 22 flows into the second space S2, which is a second layer, and exhausts to the outside as exhaust hot air. Therefore, it is possible to suppress that the boundary portion (partition wall W1) between the first space S1 and the second space S2 is continuously heated by warm air in the periphery of the fixing portion 22. Therefore, it is possible to suppress an increase in the temperature of the boundary portion (partition wall W1) between the first space S1 and the second space S2. In addition, warm air in the periphery of the fixing portion 22 flows into the second space S2 that is positioned between the first space S1 and the fixing portion 22. Therefore, it is possible to suppress that the periphery of the fixing portion 22 is cooled by cooling air flowing through the first space S1. Therefore, a decrease in the temperature of the fixing portion 22 is suppressed and it is possible to suppress an increase in power consumption.

Here, air within the housing 11 contains moisture evaporated from the sheet S as the sheet S is heating by the fixing portion 22, and thus has a relatively high humidity. Therefore, when there is a temperature difference in the flow of a plurality of types of air flowing through the housing 11, moisture in air condenses in the boundary portion between a space through which warm air flows and a space through which cold air flows. Therefore, water droplets may adhere to the boundary portion. For example, in the embodiment, the water droplets adhere to the boundary portion (partition wall W1) between the first space S1 and the second space S2 due to the dew condensation.

Therefore, in the embodiment, the boundary portion (partition wall W1) between the first space S1 and the second space S2 is disposed on a side opposite to the transporting path T of the sheet S with respect to the first bottom wall portion 33*a* of the heat exhaust path forming member 33 in which the second opening portion 42 is provided. In other words, the partition wall W1 on which the dew condensation occurs is disposed at a position deep with respect to the transporting path T of the sheet S. That is, the boundary portion (partition wall W1) between the first space S1 and the second space S2 is formed by a wall different from a wall forming the transporting path T of the sheet S. Therefore, it is possible to suppress that moisture adheres to the sheet S passing through the transporting path T.

In the embodiment, the first opening portion 41 is provided at a position which is covered by the control panel 16. Therefore, the first opening portion 41 is unlikely to be seen from the operator. Therefore, it is possible to enhance an appearance of the image forming apparatus 1. Furthermore, if the first opening portion 41 is provided at a position which is covered by the control panel 16, it is possible to reduce a possibility of accidentally dropping objects in the first opening portion 41. Furthermore, if the first opening portion 41 is provided at the position which is covered by the control panel 16, some of air flowing into the first opening portion 41 also comes into contact with the control panel 16 as forced convection air. Therefore, it is possible to more efficiently cool the control panel 16.

Second Embodiment

Next, a second embodiment will be described with reference to FIGS. 7 to 16. The second embodiment is different from the first embodiment in that a ventilation path is also formed behind a front cover 61. Moreover, in the second embodiment, configurations other than the following description are the same as those in the first embodiment. Therefore, the same reference numerals are given to the configurations having the same or similar functions and duplicate explanation will be omitted.

Figure 7:
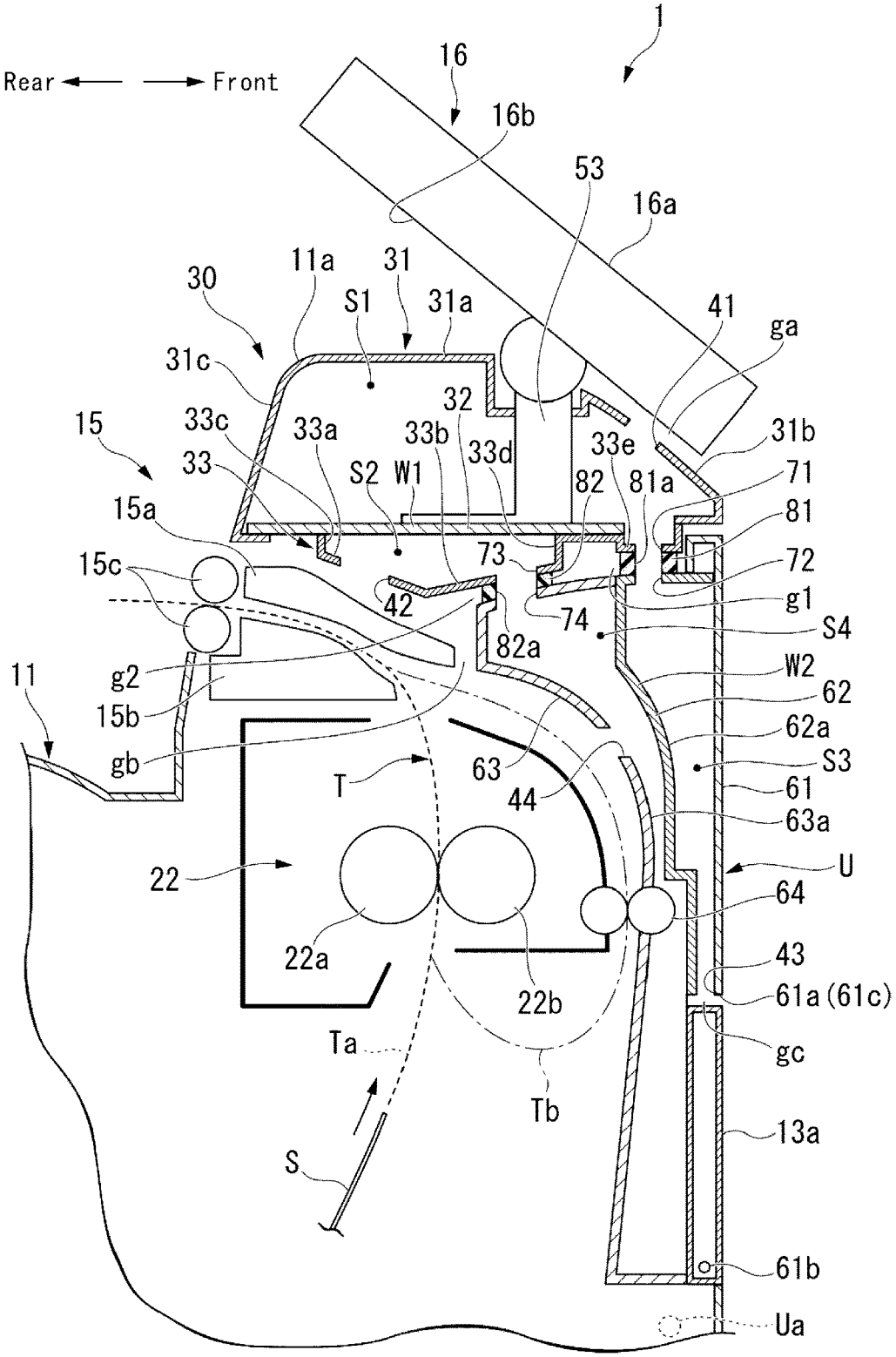
FIG. 7 is a sectional view illustrating an image forming apparatus of a second embodiment.

FIG. 7 is a sectional view illustrating an image forming apparatus 1 of the second embodiment.

As illustrated in FIG. 7, a cooling structure 30 of the image forming apparatus 1 of the embodiment includes a top cover 31, a stay member 32, a heat exhaust path forming member 33, an ADU unit U, a first sponge member 81, a second sponge member 82, and a blowing portion 34.

The ADU unit U includes a front cover 61, a ventilation path forming member 62, a transport guide 63, and a transport roller 64.

First, the front cover 61 will be described.

The front cover 61 is an example of a "second exterior member". The front cover 61 forms a part of an outer shell of the image forming apparatus 1 as a part of a housing 11. The front cover 61 extends along a substantially perpendicular direction. For example, the front cover 61 forms a part of a front surface (front surface of the housing 11) of the image forming apparatus 1. At least a part of the front cover 61 is arranged in a substantially the horizontal direction with a fixing portion 22.

In the embodiment, the front cover 61 has a recessed portion 61*a* that accommodates a manual feeding tray 13*a* (see FIG. 1). The recessed portion 61*a* is recessed rearward from a surface of the front cover 61. The manual feeding tray 13*a* is rotatable around a rotation portion 61*b* provided at a lower end portion of the manual feeding tray 13*a*. The manual feeding tray 13*a* is movable between an accommodated position which is accommodated in the recessed portion 61*a* and a using position which projects to an outside of the recessed portion 61*a*. The front cover 61 has a ceiling surface 61*c* (upper surface) which forms an upper end portion of the recessed portion 61*a*. A gap gc is formed between the ceiling surface 61*c* and a leading end portion of the manual feeding tray 13*a* as a gap for opening and closing the manual feeding tray 13*a*. The gap gc is substantially 3 mm.

The front cover 61 has at least one (for example, plural) third opening portion 43 that is opened to the outside (outside of the housing 11) of the image forming apparatus 1. For example, the third opening portion 43 is provided on the ceiling surface 61*c* of the front cover 61. The third opening portion 43 is opened downward. The third opening portion 43 is positioned at a lower end portion of a third space S3 which is described below.

Figure 8:
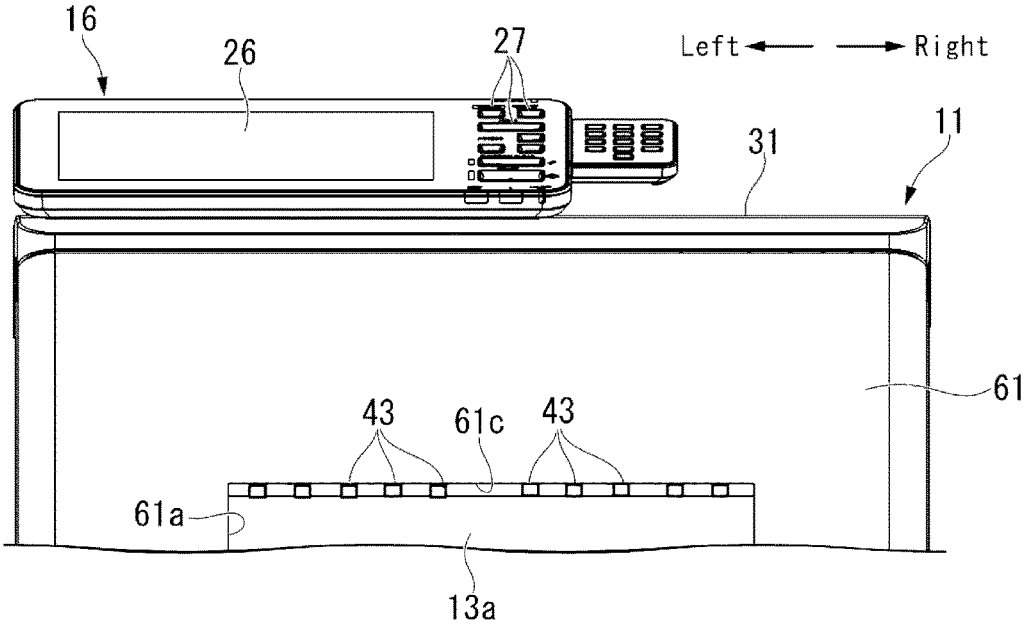
FIG. 8 is a view of a front cover of the second embodiment as seen from obliquely downward.

FIG. 8 is a view of the front cover 61 as seen from obliquely downward.

As illustrated in FIG. 8, a plurality of third opening portions 43 are arranged in a width direction of the housing 11 in the ceiling surface 61*c* of the front cover 61. Since the third opening portion 43 is provided on the ceiling surface 61*c* of the front cover 61, it is difficult to see from the operator.

Next, a ventilation path forming member 62 will be described.

The ventilation path forming member 62 is an example of a "third ventilation guide".

Figure 9:
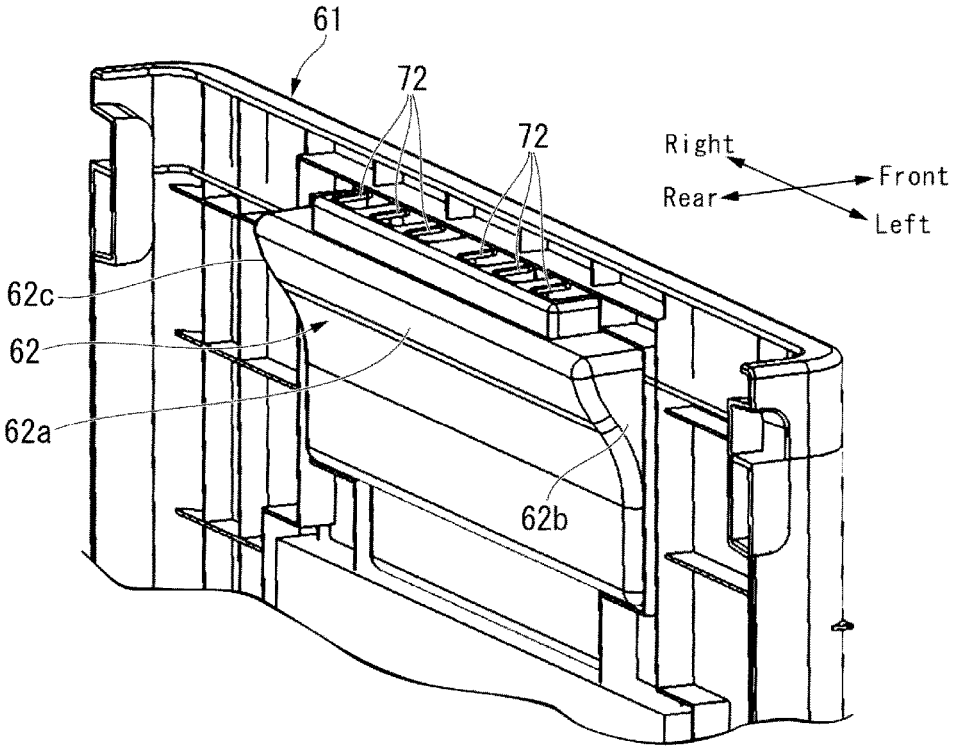
FIG. 9 is a perspective view illustrating a ventilation path forming member of the second embodiment.

FIG. 9 is a perspective view illustrating a ventilation path forming member 62 in a state where a transport guide 63 which is described below is removed. As illustrated in FIG. 9, the ventilation path forming member 62 is attached to an inner surface of the front cover 61. For example, the ventilation path forming member 62 is provided at a center portion of the front cover 61 in the width direction of the housing 11. The ventilation path forming member 62 has a rear wall 62*a*, a first side wall 62*b*, and a second side wall 62*c*. The rear wall 62*a* is away from the inner surface of the front cover 61. For example, the first side wall 62*b* extends from a left end portion of the rear wall 62*a* to the front cover 61. The second side wall 62*c* extends from a right end portion of the rear wall 62*a* to the front cover 61. Therefore, the ventilation path forming member 62 is formed in a recessed shape of which a front side is opened.

As illustrated in FIG. 7, the ventilation path forming member 62 is disposed between the front cover 61 and the fixing portion 22. The front cover 61 faces the internal space of the ventilation path forming member 62 from the front side. Therefore, the third space S3, which is at least a part of a third ventilation path through which cooling air flows, is formed between the ventilation path forming member 62 and the front cover 61. For example, the third space S3 is a space surrounded by the rear wall 62*a*, the first side wall 62*b*, and the second side wall 62*c* of the ventilation path forming member 62, and the front cover 61. The third space S3 communicates with the third opening portion 43 of the front cover 61. The third space S3 is formed along the inner surface of the front cover 61. For example, the third space S3 is formed along a perpendicular direction.

Here, the third space S3 communicates with the first space S1 described above. Hereinafter, an example of a communication structure causing the third space S3 and the first space S1 to communicate with each other will be described.

As illustrated in FIG. 7, the heat exhaust path forming member 33 has a projection portion 33*e* which is positioned between the ventilation path forming member 62 and the top cover 31. The projection portion 33*e* has at least one (for example, plural) first hole 71 communicating with the first space S1. The first hole 71 is positioned above the ventilation path forming member 62.

Figure 10:
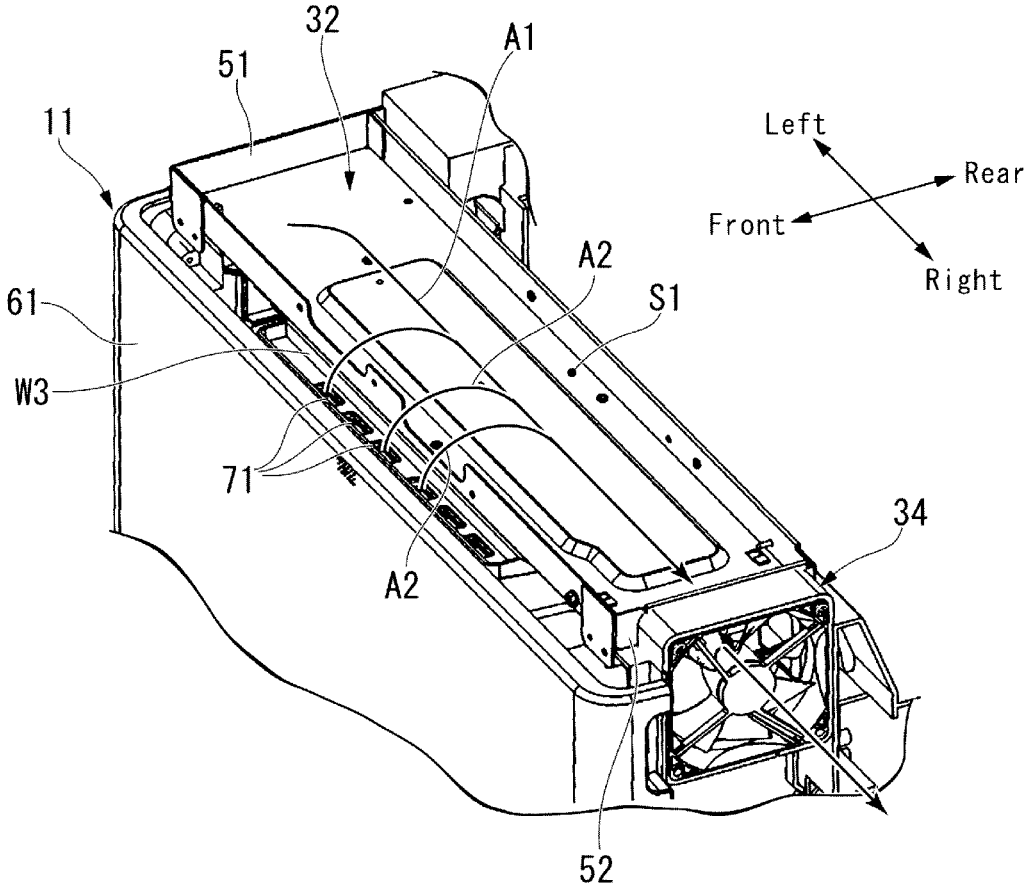
FIG. 10 is a perspective view illustrating a stay member and a heat exhaust path forming member of the second embodiment.

FIG. 10 is a perspective view illustrating the stay member 32 and the heat exhaust path forming member 33 in a state where the top cover 31 is removed. As illustrated in FIG. 10, a plurality of first holes 71 are arranged in the width direction of the housing 11.

On the other hand, as illustrated in FIG. 7, the upper end portion of the ventilation path forming member 62 has at least one (for example, plural) second hole 72 communicating with the third space S3. The second hole 72 faces the first hole 71 of the heat exhaust path forming member 33. A plurality of second holes 72 are arranged in the width direction of the housing 11 so as to correspond to the plurality of first holes 71. Therefore, the third space S3 communicates with the first space S1 through the first hole 71 and the second hole 72. The second hole 72 is an example of an opening portion causing the third space S3 and the first space S1 to communicate with each other. Here, for example, a sum of opening areas of the plurality of second holes 72 is greater than a sum of opening areas of the plurality of third opening portions 43. Therefore, pressure loss is unlikely to occur within the third space S3.

Next, the transport guide 63 will be described.

The transport guide 63 is an example of a "fourth ventilation guide".

Figure 11:
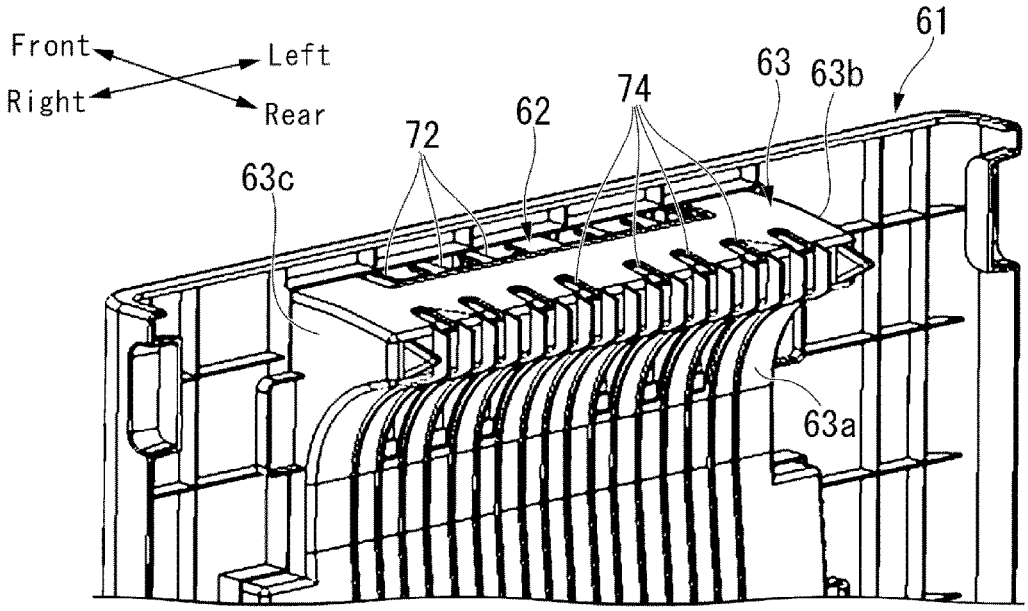
FIG. 11 is a perspective view illustrating a transport guide of the second embodiment.

FIG. 11 is a perspective view illustrating the transport guide 63. As illustrated in FIG. 11, the transport guide 63 is attached to the inner surface of the front cover 61 or the ventilation path forming member 62 so as to cover the ventilation path forming member 62. For example, the transport guide 63 is provided at a center portion of the front cover 61 in the width direction of the housing 11. The transport guide 63 has a rear wall 63*a*, a first side wall 63*b*, and a second side wall 63*c*. The rear wall 63*a* is away from the rear wall 62*a* of the ventilation path forming member 62. The rear wall 63*a* defines one surface of the transporting path Tb (reverse path) of the sheet S during double-sided printing. That is, the rear wall 63*a* comes into contact with the sheet S during double-sided printing thereby guiding the sheet S. The first side wall 63*b* extends from the left end portion of the rear wall 63*a* to the front cover 61. The second side wall 63*c* extends from the right end portion of the rear wall 63*a* to the front cover 61. Therefore, the transport guide 63 is formed in a recessed shape of which a front side is opened.

As illustrated in FIG. 7, the rear wall 63*a* of the transport guide 63 has at least one (for example, plural) fourth opening portion 44 which is opened to the inside of the housing 11. In the embodiment, a plurality of fourth opening portions 44 are arranged in the width direction of the housing 11. The fourth opening portion 44 is opened closer to the fixing portion 22 than the third space S3. The fourth opening portion 44 communicates with the transporting path Tb. For example, the fourth opening portion 44 is directly exposed to the transporting path Tb. The fourth opening portion 44 communicates with at least a part of a space of a periphery of the fixing portion 22 through the transporting path T. For example, the fourth opening portion 44 is provided at a position above from the fixing portion 22.

As illustrated in FIG. 7, the transport guide 63 is disposed between the ventilation path forming member 62 and the fixing portion 22. The ventilation path forming member 62 faces the internal space of the transport guide 63 from the front side. Therefore, a fourth space S4, which is at least a part of a fourth ventilation path through which exhaust hot air flows, is formed between the transport guide 63 and the ventilation path forming member 62. For example, the fourth space S4 is a space surrounded by the rear wall 63*a*, the first side wall 63*b*, and the second side wall 63*c* of the transport guide 63, and the ventilation path forming member 62. The fourth space S4 communicates with the fourth opening portion 44 of the transport guide 63. The fourth space S4 is formed along the inner surface of the transport guide 63. For example, the fourth space S4 is formed along a perpendicular direction.

At least one of the ventilation path forming member 62 and the transport guide 63 has a partition wall W2 that partitions between the third space S3 and the fourth space S4. The partition wall W2 forms a boundary portion between the third space S3 and the fourth space S4. In the embodiment, the partition wall W2 is formed by the ventilation path forming member 62. The partition wall W2 is positioned on a side opposite to the transporting path T of the sheet S with respect to the rear wall 63*a* of the transport guide 63. In other words, the partition wall W2 is positioned farther away from the rear wall 63*a* of the transport guide 63 with respect to the transporting path T of the sheet S. The partition wall W2 is an example of the "third wall". The rear wall 63*a* of the transport guide 63 is an example of the "fourth wall".

Here, the fourth space S4 communicates with the second space S2 described above. Hereinafter, an example of a communication structure causing the fourth space S4 and the second space S2 to communicate with each other will be described.

As illustrated in FIG. 7, the second bottom wall portion 33*b* of the heat exhaust path forming member 33 has at least one (for example, plural) third hole 73 communicating with the second space S2. The third hole 73 is positioned above the transport guide 63.

Figure 12:
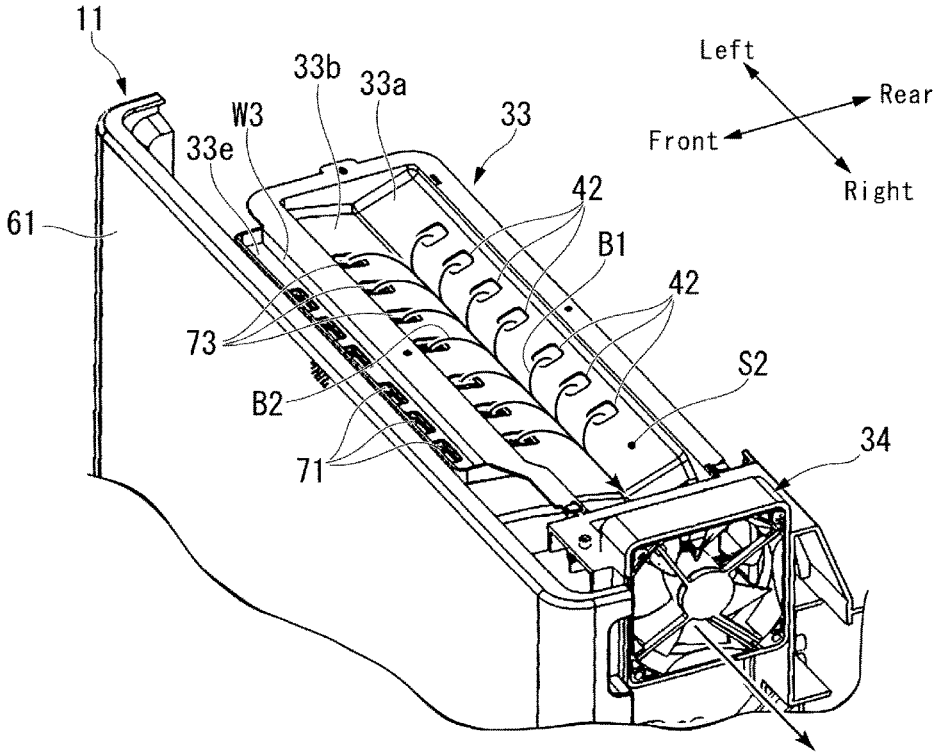
FIG. 12 is a perspective view illustrating the heat exhaust path forming member of the second embodiment.

FIG. 12 is a perspective view illustrating the heat exhaust path forming member 33 in a state where the top cover 31 and the stay member 32 are removed. As illustrated in FIG. 12, a plurality of third holes 73 are arranged in the width direction of the housing 11. The heat exhaust path forming member 33 has a partition wall W3 that is upright at a position between the first hole 71 and the third hole 73. The partition wall W3 partitions between the first hole 71 and the third hole 73.

On the other hand, as illustrated in FIG. 7, an upper end portion of the transport guide 63 has at least one (for example, plural) fourth hole 74 communicating with the fourth space S4. The fourth hole 74 faces the third hole 73 of the heat exhaust path forming member 33. A plurality of fourth holes 74 are arranged in the width direction of the housing 11 so as to correspond to the plurality of third holes 73. Therefore, the fourth space S4 communicates with the second space S2 through the third hole 73 and the fourth hole 74. The fourth hole 74 is an example of the opening portion causing the fourth space S4 and the second space S2 to communicate with each other. Here, for example, a sum of opening areas of the plurality of fourth holes 74 is greater than a sum of opening areas of the plurality of fourth opening portions 44. Therefore, pressure loss is unlikely to occur within the fourth space S4.

The ADU unit U described above is rotatable with respect to a remaining portion of the image forming apparatus 1 around a rotation shaft Ua provided at a lower end portion of the ADU unit U (see FIG. 7). Therefore, for example, when paper jam occurs, the operator rotates the ADU unit U to the front side of the housing 11 to access the inside of the housing 11.

In the embodiment, in order to allow the rotation of the ADU unit U, a first gap g1 is formed between the heat exhaust path forming member 33 and the ventilation path forming member 62 (between the top cover 31 or the stay member 32 and the ventilation path forming member 62). Similarly, in order to allow the rotation of the ADU unit U, a second gap g2 is formed between the heat exhaust path forming member 33 and the transport guide 63. The first gap g1 and the second gap g2 are respectively closed by a first sponge member 81 and a second sponge member 82.

Next, the first sponge member 81 will be described.

The first sponge member 81 is an example of a "first elastic member". For example, the first sponge member 81 is positioned between the top cover 31 and the ventilation path forming member 62. In the embodiment, the first sponge member 81 is positioned between the projection portion 33*e* of the heat exhaust path forming member 33 and the ventilation path forming member 62 to be positioned between the top cover 31 and the ventilation path forming member 62. The first sponge member 81 is sandwiched between the heat exhaust path forming member and the ventilation path forming member 62, and is elastically deformed between the heat exhaust path forming member 33 and the ventilation path forming member 62. Therefore, the first sponge member 81 closes the first gap g1 between the heat exhaust path forming member 33 and the ventilation path forming member 62 in the periphery of the first hole 71 and the second hole 72. The first sponge member 81 has a first communication port 81*a* causing the first hole 71 and the second hole 72 to communicate with each other. The third space S3 communicates with the first space S1 through the second hole 72 of the ventilation path forming member 62, the first communication port 81*a* of the first sponge member 81, and the first hole 71 of the heat exhaust path forming member 33.

Figure 13:
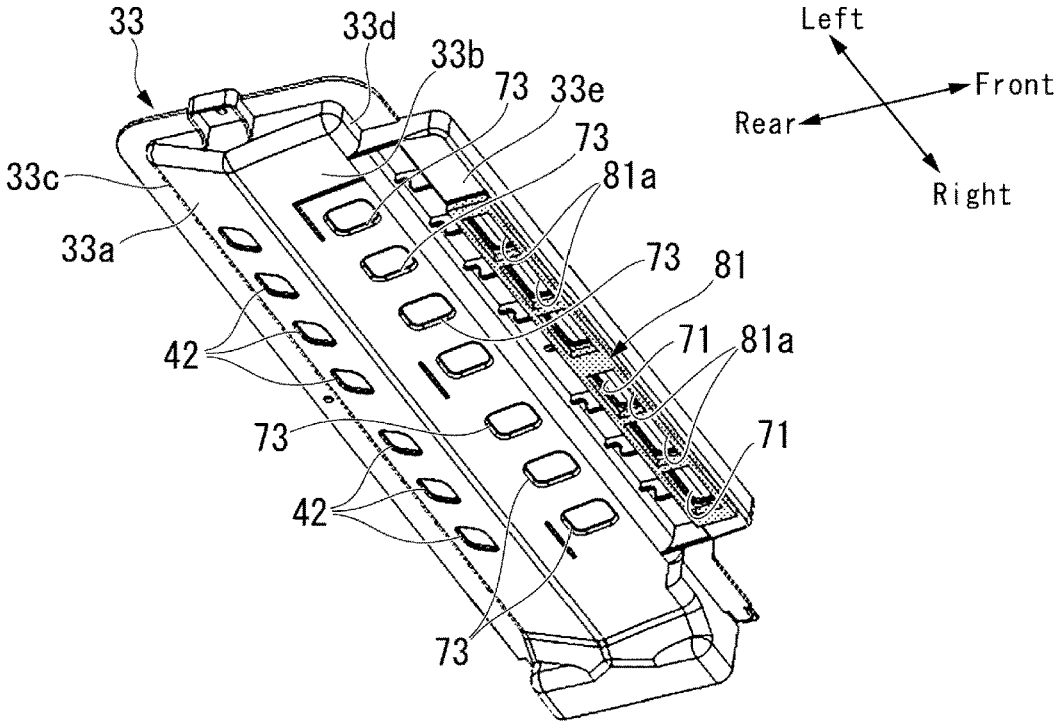
FIG. 13 is a perspective view illustrating a first sponge member of the second embodiment.

FIG. 13 is a perspective view illustrating the first sponge member 81. FIG. 13 is a view in which the heat exhaust path forming member 33, to which the first sponge member 81 is attached, is viewed from obliquely downward. As illustrated in FIG. 13, the first sponge member 81 is attached to a lower surface of the heat exhaust path forming member 33. For example, the first sponge member 81 is fixed to the lower surface of the heat exhaust path forming member 33 by adhesive, a double-sided tape, or the like.

Next, the second sponge member 82 will be described.

The second sponge member 82 is an example of a "second elastic member". The second sponge member 82 is positioned between the heat exhaust path forming member 33 and the transport guide 63. The second sponge member 82 is sandwiched between the heat exhaust path forming member 33 and the transport guide 63, and is elastically deformed between the heat exhaust path forming member 33 and the transport guide 63. Therefore, the second sponge member 82 closes the second gap g2 between the heat exhaust path forming member 33 and the transport guide 63 in the periphery of the third hole 73 and the fourth hole 74. The second sponge member 82 has a second communication port 82*a* causing the third hole 73 and the fourth hole 74 to communicate with each other. The fourth space S4 communicates with the second space S2 through the fourth hole 74 of the transport guide 63, the second communication port 82*a* of the second sponge member 82, and the third hole 73 of the heat exhaust path forming member 33.

Figure 14:
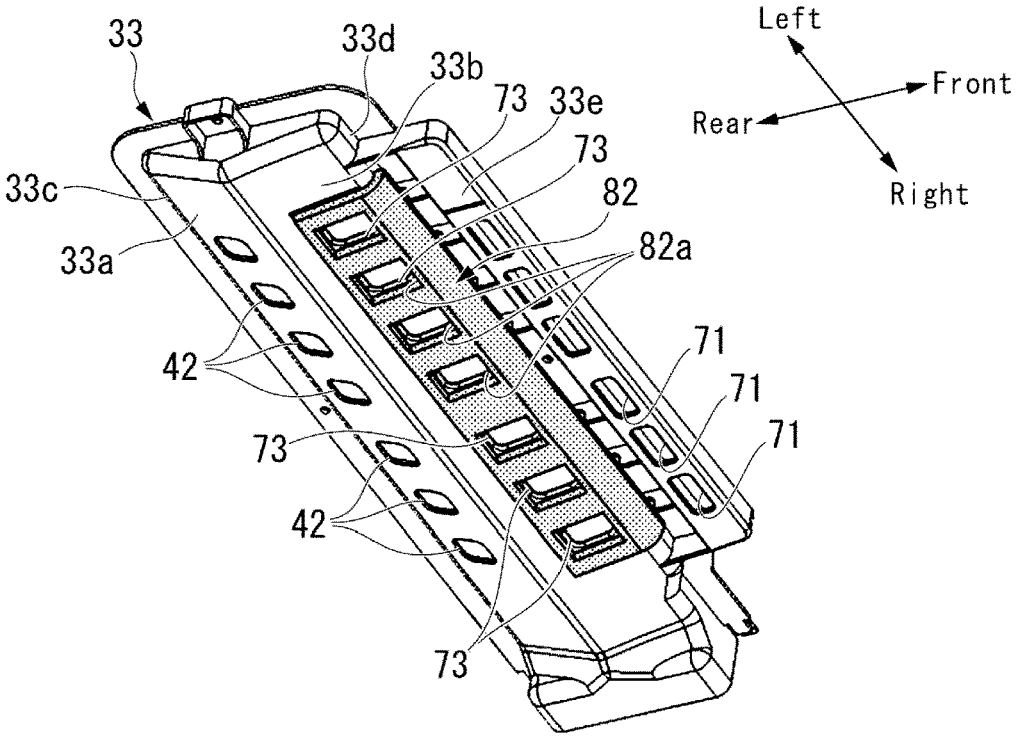
FIG. 14 is a perspective view illustrating a second sponge member of the second embodiment.

FIG. 14 is a perspective view illustrating the second sponge member 82. FIG. 14 is a view in which the heat exhaust path forming member 33, to which the second sponge member 82 is attached, is viewed from obliquely downward. As illustrated in FIG. 14, the second sponge member 82 is attached to a lower surface of the heat exhaust path forming member 33. For example, the second sponge member 82 is fixed to the lower surface of the heat exhaust path forming member 33 by adhesive, a double-sided tape, or the like.

Next, an operation of the image forming apparatus 1 of the embodiment will be described.

Figure 15:
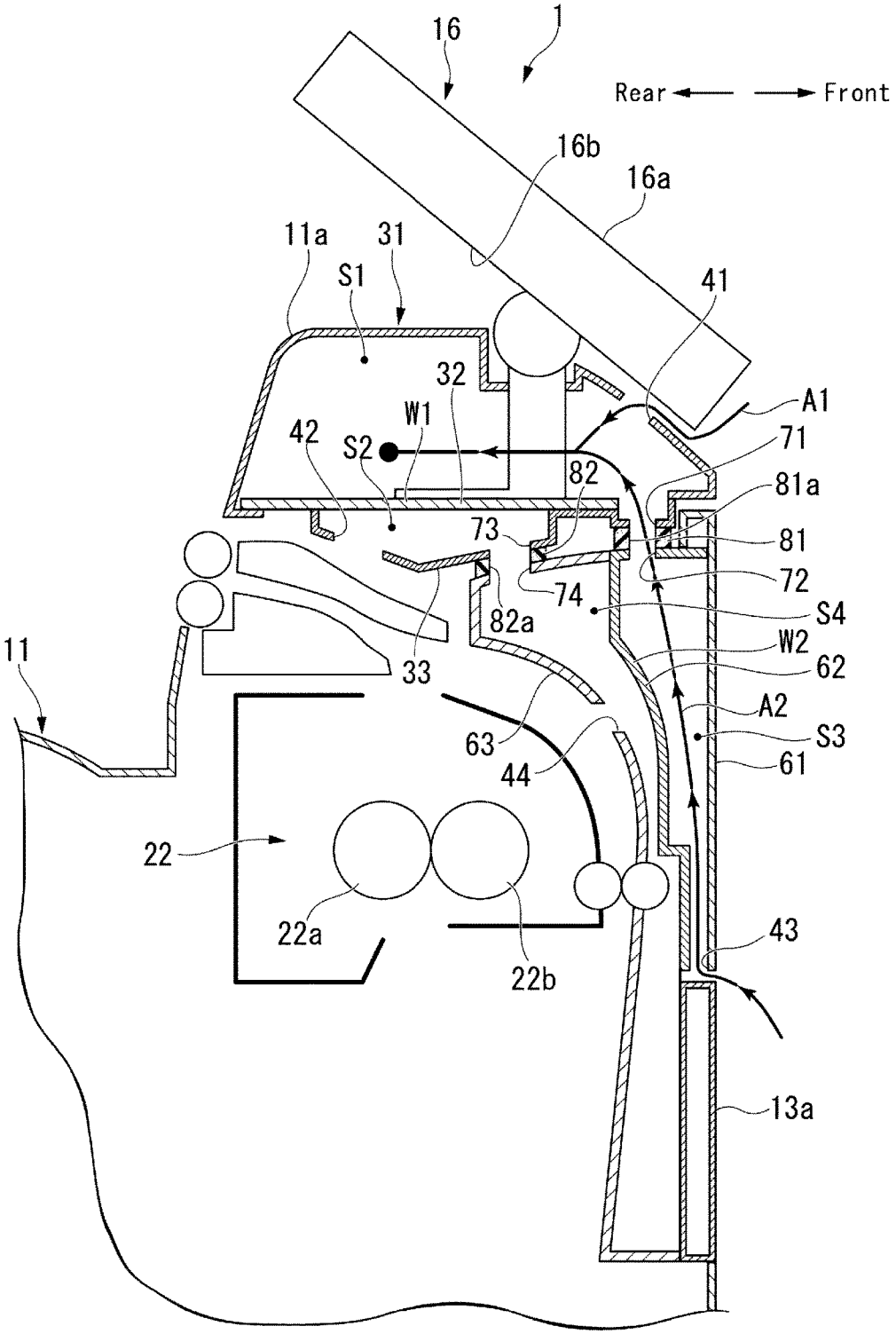
FIG. 15 is a sectional view illustrating a path of cooling air of the second embodiment.

In the embodiment, when the blowing portion 34 is driven, as illustrated by an arrow A2 in FIG. 15, cold air of the outside of the housing 11 flows into the third space S3 from the third opening portion 43 as cooling air in addition to the flow of air of the arrow A1 explained in the first embodiment. Therefore, air flowing into the third space S3 from the third opening portion 43 flows into the third space S3 upward. Some of air flowing into the third space S3 from the third opening portion 43 flows along the inner surface of the front cover 61. Therefore, cooling of the front cover 61 is promoted. In addition, some of air flowing into the third space S3 from the third opening portion 43 flows along the partition wall W2 that partitions between the third space S3 and the fourth space S4. Therefore, cooling of the partition wall W2 is promoted. Air flowing through the third space S3 flows into the first space S1 through the second hole 72 of the ventilation path forming member 62, the first communication port 81*a* of the first sponge member 81, and the first hole 71 of the heat exhaust path forming member 33. Air flowing into the first space S1 merges with air flowing into the first space S1 through the first opening portion 41 and exhausts to the outside of the image forming apparatus 1.

Figure 16:
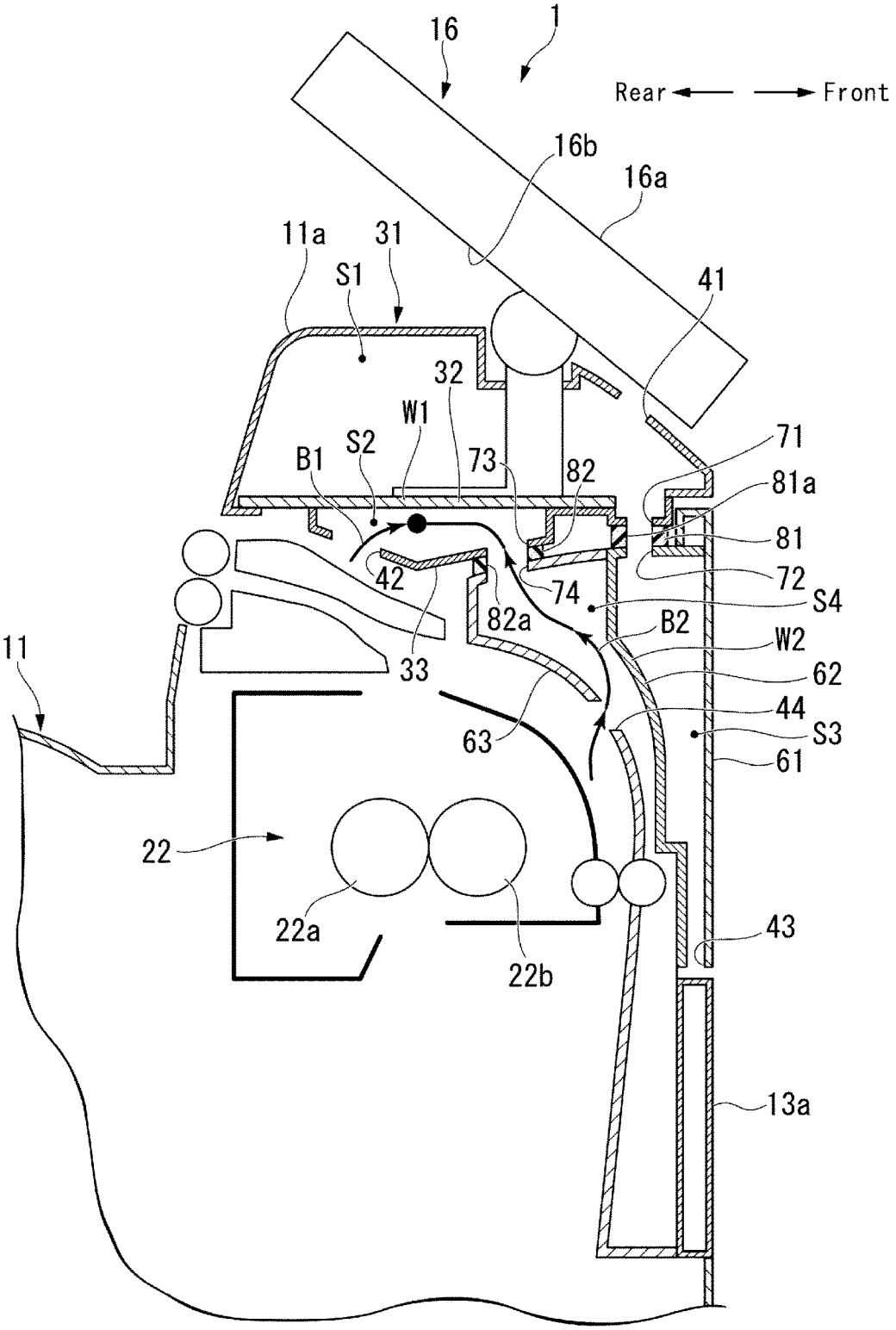
FIG. 16 is a sectional view illustrating a path of exhaust hot air of the second embodiment.

In addition, when the blowing portion 34 is driven, as illustrated by an arrow B2 in FIG. 16, some of air that is positioned in the periphery of the fixing portion 22 and the transporting path T flows into the fourth space S4 from the fourth opening portion 44 as exhaust hot air in addition to the flow of air of the arrow B1 explained in the first embodiment. Therefore, air flowing into the fourth space S4 from the fourth opening portion 44 flows into the fourth space S4 upward. Air flowing into the fourth space S4 flows into the second space S2 through the fourth hole 74 of the transport guide 63, the second communication port 82*a* of the second sponge member 82, and the third hole 73 of the heat exhaust path forming member 33. Air flowing into the second space S2 merges with air flowing into the second space S2 through the second opening portion 42 and exhausts to the outside of the image forming apparatus 1.

According to the configuration described above, it is possible to further efficiently cool the image forming apparatus 1. That is, in the embodiment, the ventilation path forming member 62 is disposed between the fixing portion 22 and the front cover 61. The ventilation path forming member 62 forms the third space S3 communicating with the outside between the ventilation path forming member 62 and the front cover 61. The transport guide 63 is disposed between the fixing portion 22 and the ventilation path forming member 62. The transport guide 63 has a fourth opening portion 44 that is positioned closer to the fixing portion 22 than the third space S3. The transport guide 63 forms the fourth space S4 communicating with the fourth opening portion 44 between the transport guide 63 and the ventilation path forming member 62.

According to the configuration described above, the ventilation path of a two-layer structure is also formed in the front surface portion of the housing 11. Therefore, cold air of the outside of the housing 11 flows into the third space S3, which is a first layer, as cooling air and thereby it is possible to efficiently cool the front cover 61. In addition, cooling air flows through the third space S3 and thereby the boundary portion (partition wall W2) between the third space S3 and the fourth space S4 can be cooled. Therefore, heat is unlikely to be transferred from warm air within the housing 11 to the front cover 61. Therefore, it is possible to suppress an increase in the temperature of the front cover 61.

In addition, warm air in the periphery of the fixing portion 22 flows into the fourth space S4, which is a second layer, and exhausts to the outside as exhaust hot air. Therefore, it is possible to suppress an increase in the temperature of the boundary portion (partition wall W2) between the third space S3 and the fourth space S4. In addition, warm air in the periphery of the fixing portion 22 flows into the fourth space S4 that is positioned between the third space S3 and the fixing portion 22. Therefore, it is possible to suppress that the periphery of the fixing portion 22 is cooled by cooling air flowing through the third space S3. Therefore, a decrease in the temperature of the fixing portion 22 is suppressed and it is possible to suppress an increase in power consumption.

Here, in the embodiment, the water droplets adhere to the boundary portion (partition wall W2) between the third space S3 and the fourth space S4 due to the dew condensation. Therefore, in the embodiment, the boundary portion (partition wall W2) between the third space S3 and the fourth space S4 is disposed on a side opposite to the transporting path T of the sheet S with respect to the rear wall 63*a* of the transport guide 63 in which the fourth opening portion 44 is provided. In other words, the partition wall W2 on which the dew condensation occurs is disposed at a position deep with respect to the transporting path T of the sheet S. That is, the boundary portion (partition wall W2) between the third space S3 and the fourth space S4 is formed by a wall different from a wall forming the transporting path T of the sheet S. Therefore, it is possible to suppress that moisture adheres to the sheet S passing through the transporting path T.

In the embodiment, the third opening portion 43 is provided at the ceiling surface 61*c* forming the upper end portion of the recessed portion 61*a* of the front cover 61. Therefore, the third opening portion 43 is unlikely to be seen from the operator. Therefore, it is possible to enhance an appearance of the image forming apparatus 1.

In the embodiment, the first sponge member 81 is not attached to the ventilation path forming member 62 but attached to the heat exhaust path forming member 33. Therefore, even if the ADU unit U is opened, the first sponge member 81 remains on the inside of the housing 11. Therefore, it is possible to prevent the operator from erroneously removing the first sponge member 81. This also applies to the second sponge member 82.

Above, the image forming apparatus 1 of the first and the second embodiments is described, but the embodiments are not limited to the examples described above. For example, in the embodiments described above, the top cover 31 and the heat exhaust path forming member 33 are formed in the recessed shape. Instead thereof, the stay member 32 may be formed in the recessed shape so as to face the first space 51 or the second space S2 from a plurality of directions. Similarly, the front cover 61 may be formed in the recessed shape so as to face the third space S3 from a plurality of directions. In addition, the ventilation path forming member 62 may be formed in the recessed shape so as to face the fourth space S4 from a plurality of directions.

For example, instead of the heat exhaust path forming member 33, the first hole 71 may be provided in the top cover 31 or the stay member 32. Instead of the ventilation path forming member 62, the second hole 72 may be provided in the front cover 61. Instead of the heat exhaust path forming member 33, the third hole 73 may be provided in the stay member 32. Instead of the transport guide 63, the fourth hole 74 may be provided in the ventilation path forming member 62.

Furthermore, the first sponge member 81 may be positioned between at least one of the top cover 31 and the stay member 32, and at least one of the front cover 61 and the ventilation path forming member 62. The second sponge member 82 may be positioned between at least one of the stay member 32 and the heat exhaust path forming member 33, and at least one of the ventilation path forming member 62 and the transport guide 63.

According to at least one embodiment described above, the first ventilation guide in which the first space is formed between the first exterior member and the first ventilation guide, and the second ventilation guide in which the second space is formed between the first ventilation guide and the second ventilation guide are provided. Therefore, it is possible to improve cooling efficiency of the image forming apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a fixing portion;

a first exterior member disposed above the fixing portion, the first exterior member comprises a first opening portion opened to an outside of the image forming apparatus, the first exterior member is disposed above the fixing portion, the first opening portion takes in air from outside of the image forming apparatus;

a first ventilation guide disposed between the fixing portion and the first exterior member, the first ventilation guide forms a first space communicating with the first opening portion, wherein the first space is between the first exterior member and the first ventilation guide, wherein the first space is positioned along an inner surface of the first exterior member;

a second ventilation guide disposed between the fixing portion and the first ventilation guide, the second ventilation guide comprises a second opening portion positioned closer to the fixing portion than a position of the first space, the second ventilation guide forms a second space communicating with the second opening portion, wherein the second space is between the first ventilation guide and the second ventilation guide, the second space is separate from the first space; and a blower that exhausts air to the outside of the image forming apparatus from inside the first space and the second space.

2. The image forming apparatus according to claim 1, wherein at least one of the first ventilation guide and the second ventilation guide has a first wall that partitions the first space and the second space, the second ventilation guide has a second wall that comprises the second opening portion, and the first wall is positioned on a side opposite to a transporting path through which a sheet is transported with respect to the second wall.

3. The image forming apparatus according to claim 2, wherein the second opening portion communicates with the transporting path.

4. The image forming apparatus according to claim 1, wherein the first exterior member has a first end portion and a second end portion, the second end portion is positioned on a side opposite to the first end portion, a fan is adjacent to the second end portion of the first exterior member, and the first opening portion is positioned closer to the first end portion than a center portion of the first exterior member.

5. The image forming apparatus according to claim 1, further comprising:

a control panel disposed above the first exterior member, the control panel receives an input of an operation instruction, wherein the first opening portion is provided at a position that is covered by the control panel.

6. The image forming apparatus according to claim 1, further comprising:

a second exterior member having a third opening portion opened to the outside of the image forming apparatus, wherein at least a part of the second exterior member is arranged with the fixing portion in a substantially horizontal direction;

a third ventilation guide disposed between the fixing portion and the second exterior member, the third ventilation guide forming a third space communicating with the third opening portion between the second exterior member and the third ventilation guide; and a fourth ventilation guide disposed between the fixing portion and the third ventilation guide, the fourth ventilation guide having a fourth opening portion positioned at a position closer to the fixing portion than the third space, the third ventilation guide forming a fourth space communicating with the fourth opening portion between the third ventilation guide and the fourth ventilation guide.

7. The image forming apparatus according to claim 6, wherein at least one of the second exterior member and the third ventilation guide has an opening portion causing the third space and the first space to communicate with each other, and at least one of the third ventilation guide and the fourth ventilation guide has an opening portion causing the fourth space and the second space to communicate with each other.

8. The image forming apparatus according to claim 6, wherein the second exterior member has a recessed portion accommodating a manual feeding tray and a ceiling surface forming an upper end portion of the recessed portion, and the third opening portion is provided on the ceiling surface.

9. The image forming apparatus according to claim 6, further comprising at least one of:

a first elastic member positioned between at least one of the first exterior member and the first ventilation guide, and at least one of the second exterior member and the third ventilation guide, the first elastic member having a first communication port causing the first space and the third space to communicate with each other; and a second elastic member positioned between at least one of the first ventilation guide and the second ventilation guide, and at least one of the third ventilation guide and the fourth ventilation guide, the second elastic member having a second communication port causing the second space and the fourth space to communicate with each other.

10. An image forming method, comprising:

opening a first opening portion of a first exterior member to an outside of an image forming apparatus, the first opening portion takes in air from outside of the image forming apparatus;

forming a first space communicating with the first opening portion between the first exterior member and a first ventilation guide, the first ventilation guide disposed between a fixing portion and the first exterior member, the first exterior member is disposed above the fixing portion and the first space is positioned along an inner surface of the first exterior member;

forming a second space communicating with a second opening portion between the first ventilation guide and a second ventilation guide, the second space is separate from the first space, the second ventilation guide disposed between the fixing portion and the first ventilation guide, the second ventilation guide having the second opening portion positioned closer to the fixing portion than the first space; and exhausting air from inside the first space and the second space.

11. The image forming method according to claim 10, wherein at least one of the first ventilation guide and the second ventilation guide has a first wall that partitions the first space and the second space, the second ventilation guide has a second wall in which the second opening portion is provided, and the first wall is positioned on a side opposite to a transporting path through which a sheet is transported with respect to the second wall.

12. The image forming method according to claim 11, wherein the second opening portion communicates with the transporting path.

13. The image forming method according to claim 10, wherein the first exterior member has a first end portion and a second end portion positioned on a side opposite to the first end portion, a fan is adjacent to the second end portion of the first exterior member, and the first opening portion is positioned closer to the first end portion than a center portion of the first exterior member.

14. The image forming method according to claim 10, further comprising:

receiving an input of an operation instruction.

15. The image forming method according to claim 10, further comprising:

forming a third space communicating with a third opening portion between a second exterior member and a third ventilation guide, the third ventilation guide disposed between the fixing portion and the second exterior member; and forming a fourth space communicating with a fourth opening portion between the third ventilation guide and a fourth ventilation guide, the fourth ventilation guide disposed between the fixing portion and the third ventilation guide, the fourth ventilation guide having the fourth opening portion positioned at a position closer to the fixing portion than the third space.

16. The image forming method according to claim 15, wherein at least one of the third ventilation guide and the fourth ventilation guide has an opening portion causing the fourth space and the second space to communicate with each other.

17. The image forming method according to claim 15, wherein the third opening portion is provided on a ceiling surface.

18. The image forming method according to claim 15, further comprising at least one of:

causing the first space and the third space to communicate with each other by positioning a first elastic member between at least one of the first exterior member and the first ventilation guide, and at least one of the second exterior member and the third ventilation guide, the first elastic member having a first communication port; and causing the second space and the fourth space to communicate with each other by positioning a second elastic member between at least one of the first ventilation guide and the second ventilation guide, and at least one of the third ventilation guide and the fourth ventilation guide, the second elastic member having a second communication port.

19. An apparatus comprising:

a fixing portion;

a first exterior member having a first opening portion opened to an outside of the image forming apparatus, the first exterior member is disposed above the fixing portion;

a first ventilation guide disposed between the fixing portion and the first exterior member, the first ventilation guide forming a first space communicating with the first opening portion between the first exterior member and the first ventilation guide, wherein the first space is positioned along an inner surface of the first exterior member;

a second ventilation guide disposed between the fixing portion and the first ventilation guide, the second ventilation guide having a second opening portion positioned closer to the fixing portion than the first space, the second ventilation guide forming a second space communicating with the second opening portion between the first ventilation guide and the second ventilation guide; and a blower that exhausts air from inside the first space and the second space, wherein at least one of the first ventilation guide and the second ventilation guide has a first wall that partitions the first space and the second space, the second ventilation guide has a second wall in which the second opening portion is provided, and the first wall is positioned on a side opposite to a transporting path through which a sheet is transported with respect to the second wall.

* * * * *